US007708187B2

(12) United States Patent
Keefe, Jr. et al.

(10) Patent No.: US 7,708,187 B2
(45) Date of Patent: May 4, 2010

(54) DISPLAY CONTAINER AND ASSOCIATED DISPLAY CONTAINER BLANK

(75) Inventors: Walter D. Keefe, Jr., Carol Stream, IL (US); David J McKenna, Plainfield, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/538,008

(22) Filed: Oct. 2, 2006

(65) Prior Publication Data

US 2008/0078821 A1 Apr. 3, 2008

(51) Int. Cl.
*B65D 5/18* (2006.01)

(52) U.S. Cl. ..... 229/167; 229/164; 229/172; 229/176; 229/193

(58) Field of Classification Search ..... 229/164, 229/167, 172, 174, 176, 178, 193
See application file for complete search history.

(56) References Cited

U.S. PATENT DOCUMENTS 2,781,160 A * 2/1957 Bolding ..... 229/167
2,838,221 A * 6/1958 Wilson ..... 229/178
2,845,211 A * 7/1958 Hauck et al. ..... 229/178
2,963,211 A * 12/1960 Agler ..... 229/176
3,305,078 A * 2/1967 Ferrera ..... 229/164
3,386,641 A * 6/1968 Cassidy ..... 229/167
3,924,801 A * 12/1975 Partain ..... 229/178
4,116,330 A * 9/1978 Ellis ..... 229/164
4,369,913 A * 1/1983 Muise ..... 229/178
4,372,476 A * 2/1983 Harned et al. ..... 229/178
4,441,451 A * 4/1984 Neal ..... 229/178
4,542,847 A * 9/1985 Lindstrom ..... 229/164
4,801,079 A * 1/1989 Gonella ..... 229/162.1
4,802,619 A * 2/1989 Laido ..... 229/167
4,947,985 A * 8/1990 Crabtree et al. ..... 229/162.1
5,236,122 A * 8/1993 Ballard ..... 229/178
5,277,360 A * 1/1994 DeMott ..... 229/164
2003/0141356 A1 * 7/2003 Sheffer ..... 229/167

* cited by examiner

*Primary Examiner*—Gary E Elkins

(57) ABSTRACT

The embodiments of the present invention provide a blank foldable material that may be configured to form a container. When formed, the container is self-locking and includes air cell structure that allows for a container with a constant outside volume to have a variable inside volume. The air cell structure containers functions to prevent telescoping of vertically stacked container and for strength and stability. The container may be partially assembled for shipping and hand set into final assembly as needed.

5 Claims, 8 Drawing Sheets

DISPLAY CONTAINER AND ASSOCIATED DISPLAY CONTAINER BLANK

FIELD OF THE INVENTION

This invention relates generally to cellulose-based blanks and containers and more specifically, to wood cellulose-based blanks and containers used for storing and displaying goods.

BRIEF DESCRIPTION OF THE DRAWINGS

Various embodiments of the present invention are described in detail below with reference to the following drawings.

DETAILED DESCRIPTION

The present invention provides a blank and resulting container for holding any variety of goods. By way of overview and with references to FIGS. 1 through 8. An embodiment of the present invention includes a single piece blank 20 of foldable material arranged to form a container 60. Specific details of the blank 20 in container 60 are described with more particularity below.

Figure 1:
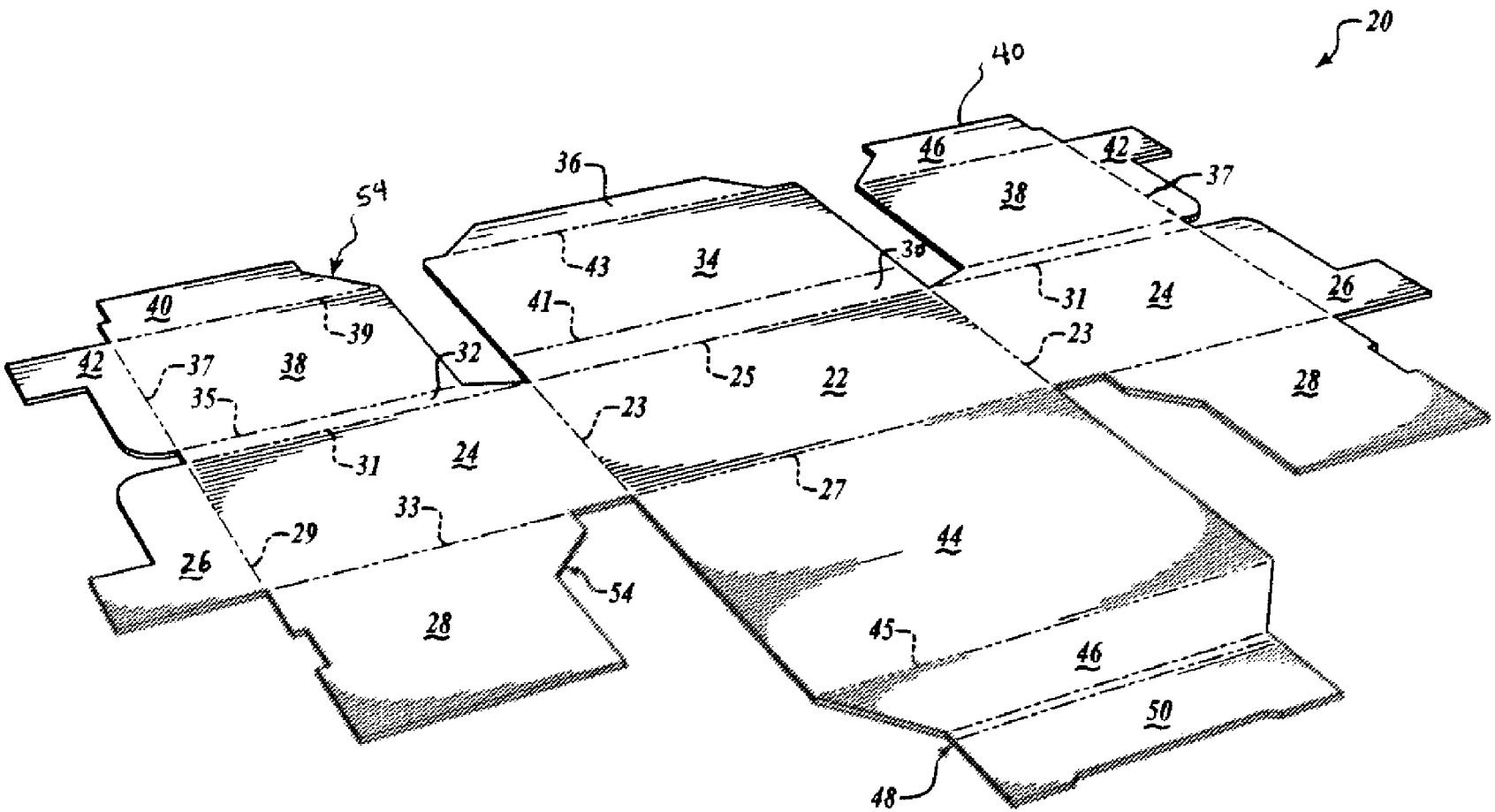
FIG. 1 is a plan view of a single piece of container blank formed in accordance with an aspect of the present invention.

FIG. 1 depicts a blank 20 used to form the container 60. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard and paperboard. The blank 20 is cut and scored, perforated or otherwise formed to include a plurality of panels that when assembled form container 60. In all FIGURES, like numbers indicate like parts. Additionally, cut lines are shown as solid lines, score lines as dashed lines, and lines of perforation as broken lines.

With respect to FIG. 1, the blank includes an outer back panel 22, opposed outer side panels 24 and outer front flaps 26. The outer back panel 22 is generally rectangular or square in shape and is connected with the outer side panels 24 along a fold line 23. The outer back panel 22 is also connected with a rear top panel 30 along a fold line 25, and with an outer bottom panel 44 along a fold line 27. As depicted in the FIGURE, fold line 23 is substantially perpendicular to fold line 25. The intersection of the respective fold lines 23 and 25 substantially define the corner of the outer back panel 22.

An outer side panel 24 is generally rectangular or square in shape. The length of the outer side panels 24 measured along fold line 23 is substantially equal to the length of the outer back panel 22 measured along the same fold line.

Outer front flap 26 is generally L-shaped and is connected with the outer side panel 24 along fold line 29. The length of the outer front flap 26 measured along fold line 29 is substantially equal to the width of the outer side panel 24 measured along the same fold line.

Inner bottom panel 28 is connected with the outer side panels 24 along fold line 33. The length of the outer side panels 24 measured along fold line 33 is generally greater than the length of the inner bottom panel 28 measured along the same fold line. Inner bottom panel 28 may include cutout 54 formed in a periphery of the panel. Likewise, inner bottom panel 28 may have a profile such that the width of the panel measured in a directed parallel to fold line 33, and at the fold line 33 is not equal to the width measured a distance perpendicular to fold line 33.

Top side panel 32 is connected with the outer side panels 24 along fold line 31. Also a inner side panel 38 is connected with the top side panel 32 along a fold line 35, which is opposite the outer side panel 24. The length of the outer side panels 24 measured along fold line 31 is generally greater than the length of the top side panel 33 measured along fold line 35.

Connected with the inner side panel 38 along a fold line 37 is an inner front flap 42. In overall shape, the inner front flap 42 is similar to the outer front flap 26, however, their relative sizes may be either the same or different.

Connected with the inner side panel 38 along a fold line 39 is an inner side panel flap 40. In overall shape, the inner side panel 40 inner is similar to the inner bottom panel 28, however, their relative sizes may be either the same or different. It will be appreciated that the cutouts 54, or portions thereof, if present, will be at least partially aligned.

An inner back panel 34 is generally rectangular or square in shape. The inner back panel 34 is connected with the rear top panel 30 along a fold line 41. The length of the inner back panel 34 measured along fold line 41 is substantially equal to the length of the outer back panel 22 measured along fold line 25. In overall shape, the inner back panel 34 is similar to the outer back panel 22. Additionally, an inner back panel flap 36 is connected with the inner back panel 34 along a fold line 43. Generally, the inner back panel flap 36 is trapezoidal in shape, however it will be appreciated that it my have other geometries as well.

Figure 2:
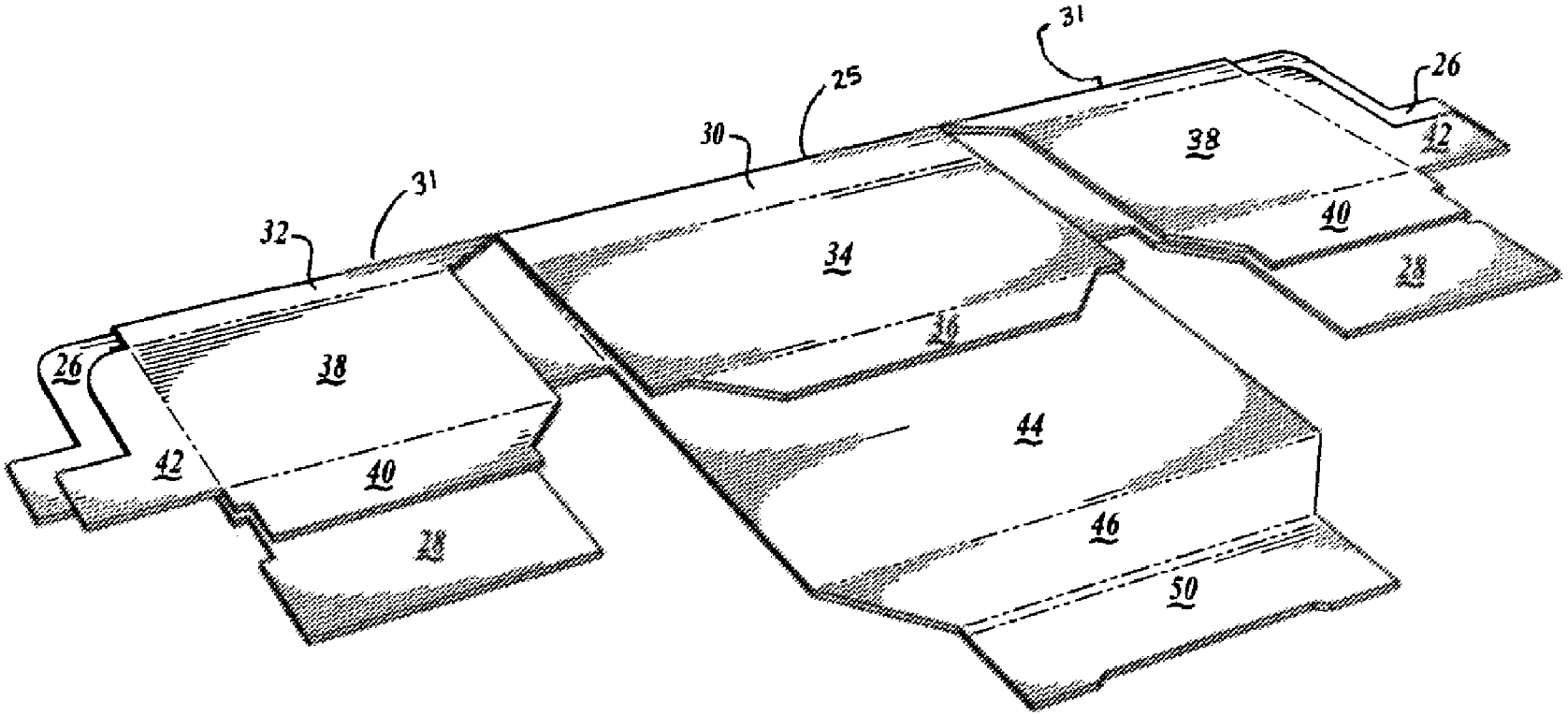
FIG. 2 is a perspective view of a partially assembled container blank shown in FIG. 1.
Figure 3:
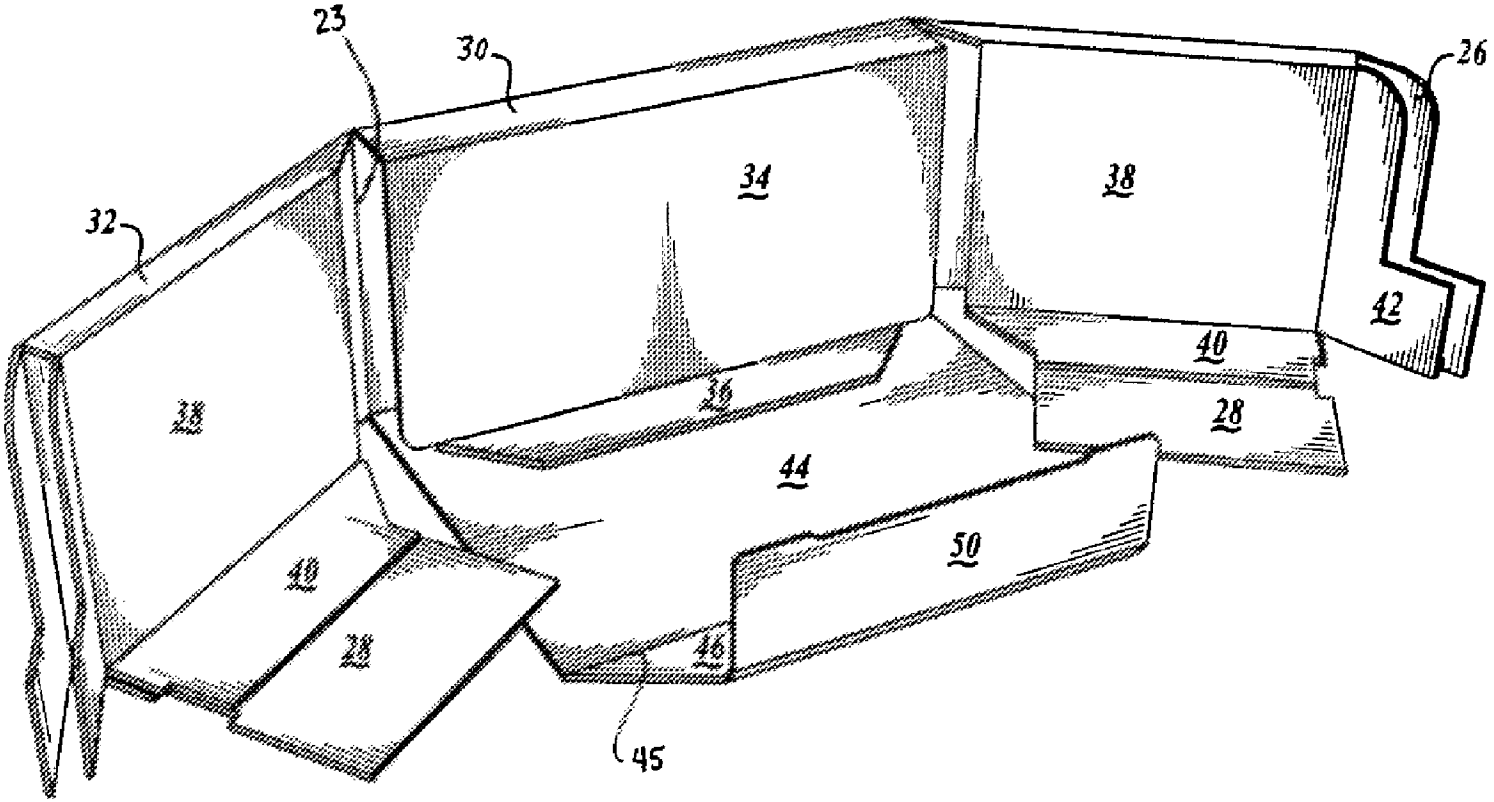
FIG. 3 is the perspective view of the partially assembled container blank shown in FIG. 2.
Figure 4:
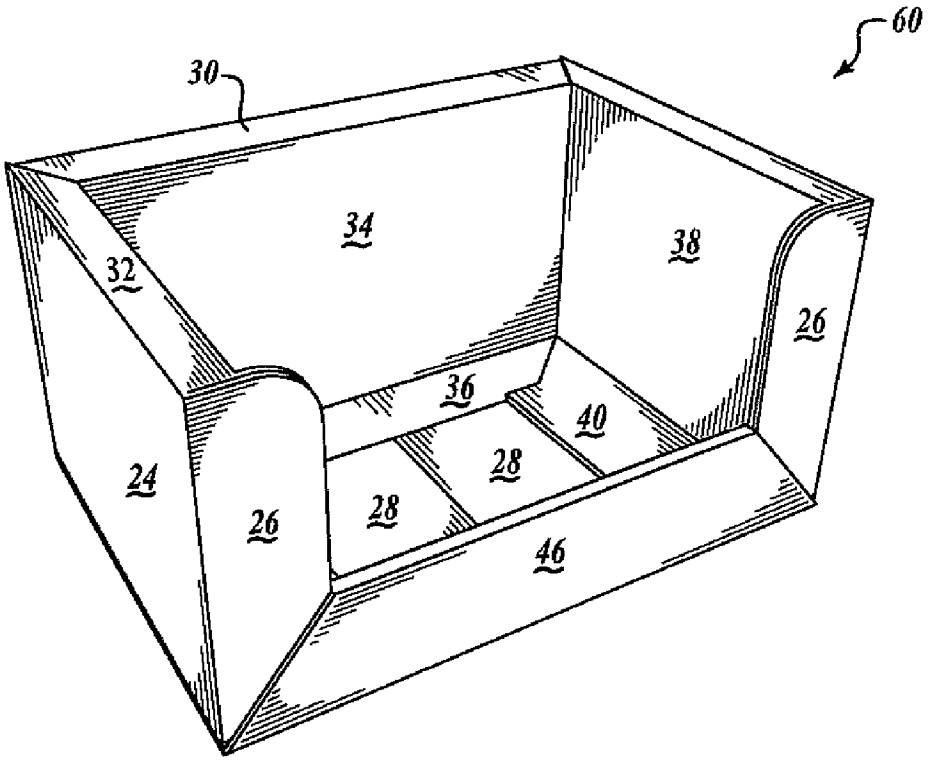
FIG. 4 is the assembled container blank shown in FIG. 3.
Figure 5:
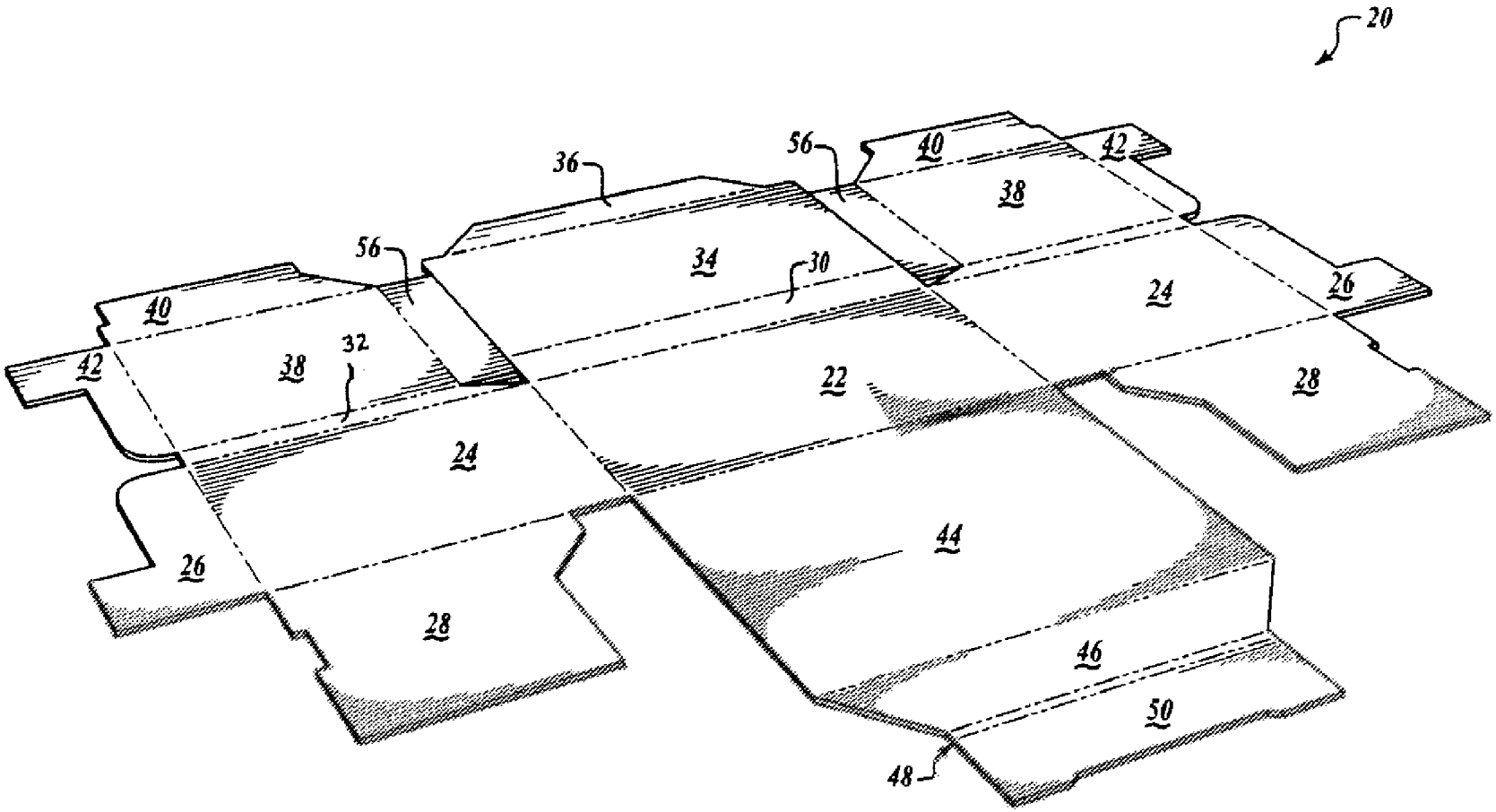
FIG. 5 a plan view of a single piece of container blank formed in accordance with another aspect of the present invention.
Figure 6:
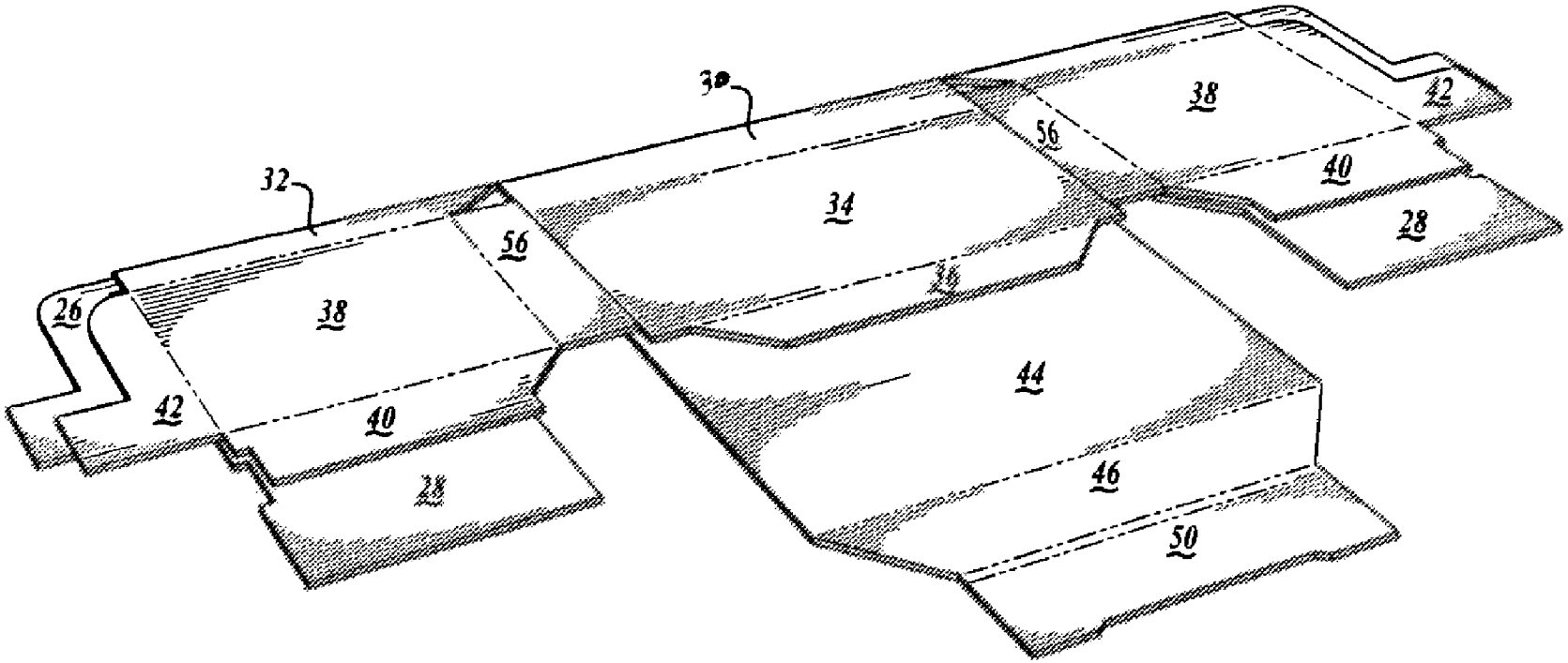
FIG. 6 is a perspective view of the partially assembled container blank of FIG. 5.
Figure 7:
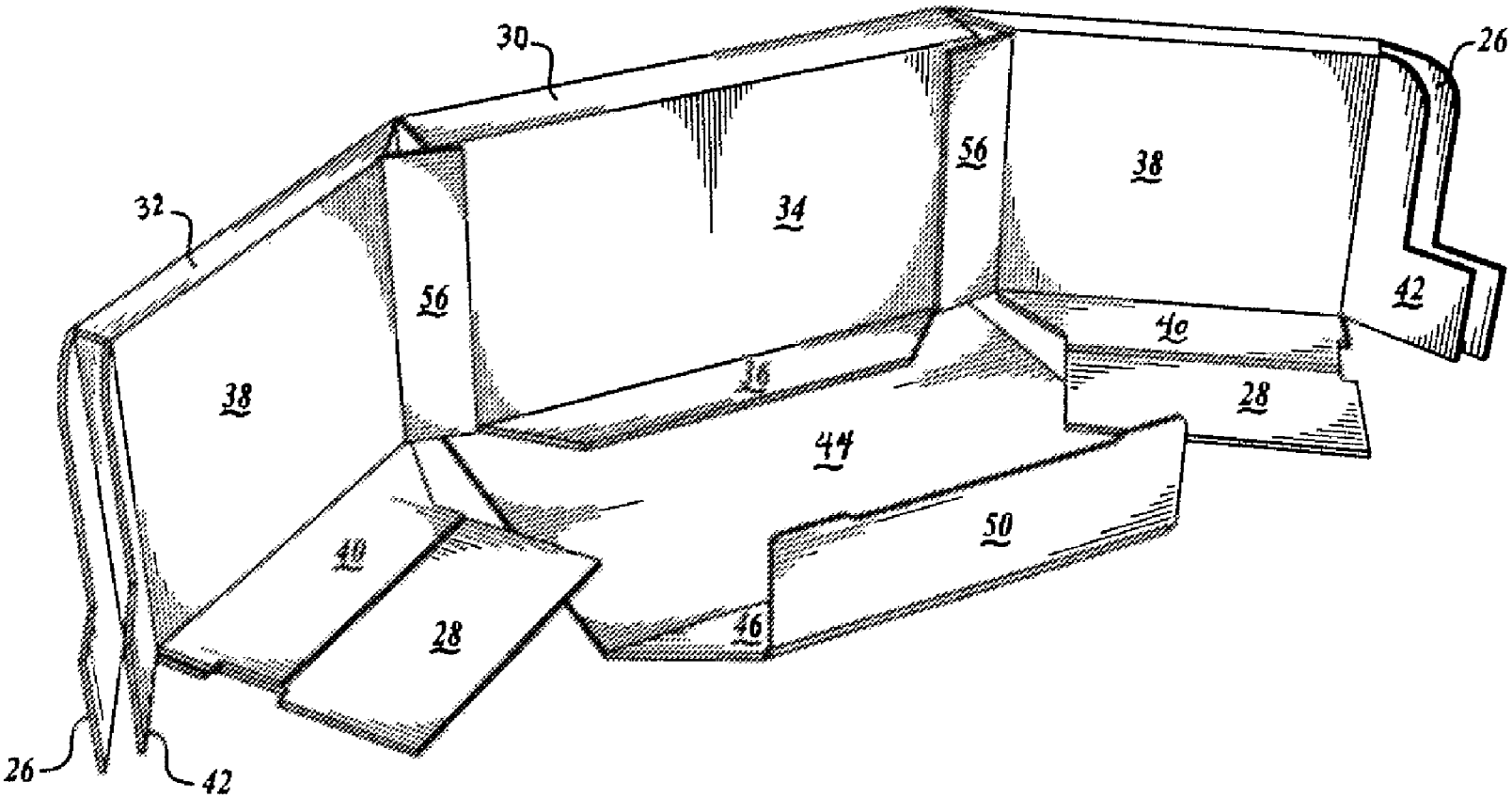
FIG. 7 is still further perspective view of a partially assembled container blank of FIG. 5.
Figure 8:
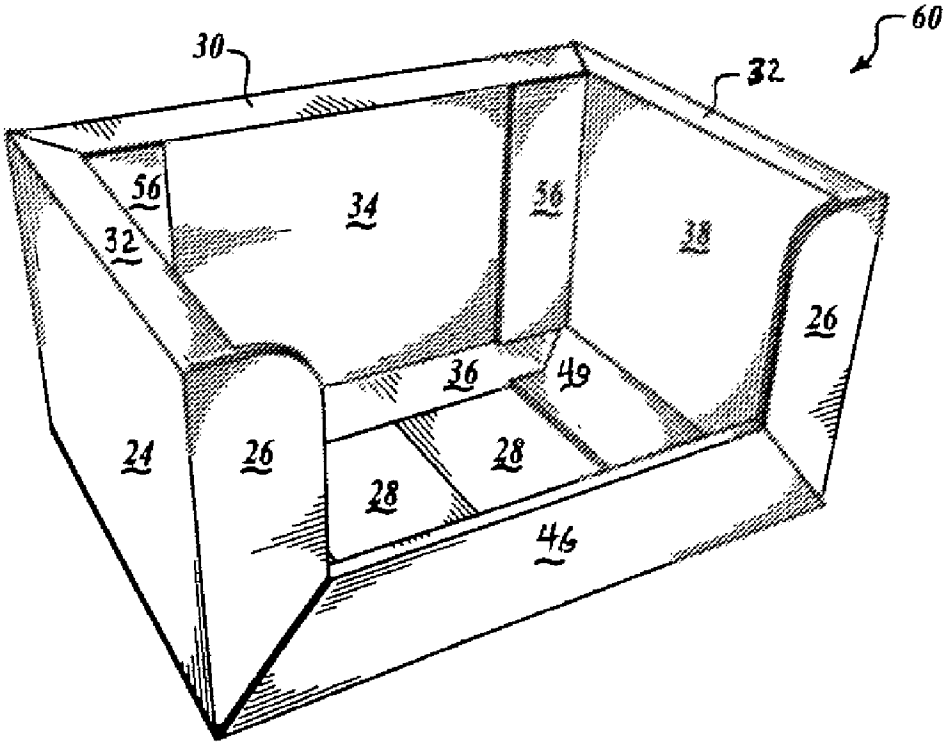
FIG. 8 is a perspective view of the assembled container blank of FIG. 5.

In order to further illustrate the various aspects about the embodiments, FIGS. 2 through 4, depict the blank 20 being erected into container 60. Typically, this is a hand-set container 60. However, it will be understood that mechanical box erecting equipment may be used in the erection of the container 60. As mechanical box erecting equipment is well know in the art a detailed description of such equipment is not necessary to understand the spirit and scope of the embodiments contained herein.

With specific reference to FIG. 2, blank 20 is folded inwardly approximately 180 degrees along fold lines 31 and 25. In doing so, the inner side panels 38 and top side panel 30 are juxtaposed the outer side panel 24. Likewise, the inner back panel 34 and rear top panel 30 are juxtaposed the outer back panel 22. Also, the various inner side and back panels 38 and 34, respectively, are arranged such that inner side panel flap 40 is juxtaposed and aligned with inner bottom panel 28. Also, inner back panel flap 36 is juxtaposed a portion of the outer bottom panel 44.

At this point the respective panels and flaps may be glued where needed and shipped in the flattened state. This aspect allows for partial assembly of the boxes while still allowing for efficient shipping arrangements.

The erection process continues with folding the various panels around fold line 23, as best seen in FIG. 3. This move puts the inner bottom panels 28 juxtaposed the outer bottom panel 44. The inner flap 42 and outer flap 26 are adjacent one another in an aligned state. Outer front panel 46 may them be folded upwardly approximately 90 degrees along fold line 45. Subsequently, the inner front panel 50 may be folded downwardly about spaced apart fold line 48, trapping the projection portions of outer front flap 26 and inner front flap 42 between the inner front panel 50 and outer front panel 46. As best seen in FIG. 4, the inner front panel 50 may be locked in place by any variety of means, including locking tabs, fasteners or adhesives (not shown). The container 60 is now ready for use.

FIGS. 5-8 depict another aspect of the present invention. Specifically, a corner panel 56 is positioned between the inner back panel 34 and the inner side panel 38. The corner panel 56 may be connected to either the inner back panel 34 or the inner side panel 38 without departing from the spirit and scope of this aspect of the invention. Those skilled in the art will appreciate that corner panel 56 serves to provide extra stacking strength to the container 60 when formed. All the erecting steps are the same as discussed in other parts of this document, so a detailed discussion of this aspect of the invention is not required for understanding. The only change is the addition of having the corner panel being juxtaposed either the inner back panel 34 or inner side panel 38, depending upon design choice.

The inner and outer side and back panels being separated by the rear top panel 30 and top side panel 32 form "air cells" between the respective inner and outer panels. Those skilled in art will appreciated that the respective size of the rear top panel 30 and top side panel 32 may be varied to achieve air cells of differing size. Thus, for a given outer box volume, any variety of inner box volume may be achieved. Having a box design with a constant outer box volume yet variable inner box volume serves to, among other things, maximize pallet space usage regardless of the overall geometry of the product being placed in the box. Also, the variable top side and rear panel size provides additional bearing surface and stability when stacking the containers 60 vertically. Further, it will be appreciated that this one piece design does not require additional corrugated inserts typically required for additional stacking strength, and/or void fillers.

The container 60 as shown is simple to manufacture, easy to assemble and may be a design of considerable usage in club stores or bulk stores where products are sold in large quantities on the open floor. However, this design is also useful in any variety of retail or wholesale environments.

While various embodiments of this invention have been illustrated and described, as noted above, many changes can be made without departing from the spirit and scope of this invention. Accordingly, the scope of the invention is not limited by the disclosure of the various embodiments. Instead, the invention should be determined entirely by references to the claims that follow.

What is claimed is:

1. A single sheet of foldable material cut and scored to define a container, the container comprising:

an outer bottom panel;

an outer back panel connected with the outer bottom panel;

a top panel connected with the outer back panel along a first fold line;

an inner back panel connected with the top panel along a second fold line;

a back panel flap connected with the inner back panel, said back panel flap being positioned such that the back panel flap lies adjacent to the outer bottom panel such that the back panel flap and the outer bottom panel lie in parallel planes;

an outer side panel connected with the outer back panel;

a top side panel connected with the outer side panel along a fourth fold line;

an inner side panel connected with the top side panel;

an inner front flap connected to the inner side panel;

an outer front flap connected to the outer side panel wherein the inner front flap and the outer front flap being adjacent and aligned with one another and wherein a portion of respective inner and outer front flaps is trapped between an inner front panel and an outer front panel;

an inner bottom panel connected to the outer side panel and juxtaposed a portion of the outer bottom panel;

a corner panel connected to the inner side panel and juxtaposed a portion of the inner back panel;

wherein the inner back panel and the outer back panel lie substantially parallel to one another yet are spaced apart from one another a distance substantially equal to the a perpendicular distance between the first and second fold lines.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

5. The container of claim 1 further comprising a second outer side panel connected to the outer back panel along the side opposite the other outer side panel, a second top side panel connected with the second outer side panel along a fold line;

a second inner side panel connected with the top side panel;

a second inner bottom panel connected to the second outer side panel and juxtaposed a portion of the outer bottom panel;

a second corner panel connected to the second inner side panel and juxtaposed a portion of the inner back panel.

* * * * *